United States Patent [19]

Howard et al.

[11] Patent Number: 4,629,106

[45] Date of Patent: Dec. 16, 1986

[54] ACTUATING MEANS FOR FASTENER DRIVING TOOL

[75] Inventors: Frank C. Howard, Mt. Prospect; Allan E. Kiefer, Fox River Grove, both of Ill.

[73] Assignee: Signode Corporation, Glenview, Ill.

[21] Appl. No.: 737,780

[22] Filed: May 29, 1985

[51] Int. Cl.[4] ..... B25C 1/00; B25C 1/04; B25C 5/00

[52] U.S. Cl. ..... 227/8; 227/130

[58] Field of Search ..... 227/8, 120, 130, 131

[56] References Cited

U.S. PATENT DOCUMENTS 4,509,668 4/1985 Klaus et al. ..... 227/8

4,523,646 6/1985 Doyle et al. ..... 227/8 X

*Primary Examiner*—Robert L. Spruill

*Assistant Examiner*—Taylor J. Ross

*Attorney, Agent, or Firm*—Dressler, Goldsmith, Shore, Sutker & Milnamow, Ltd.

[57] ABSTRACT

A fastener driving tool which employs an activating mechanism, which mechanism will only be effective to fire the tool if operated in the proper sequence. The activating mechanism includes a trigger assembly and a bottom trip mechanism which is operable when the tool is placed in contact with the workpiece. The trigger mechanism is designed so that it will only operate to fire the tool if it is moved after the tool has been placed in contact with the workpiece. Pulling of the trigger before the workpiece is contacted will prevent firing of the tool. The trigger mechanism is also designed so that it includes an arrangement whereby once the tool has been fired the tool can be fired repeatedly upon repeated contact of the tool with the workpiece.

13 Claims, 10 Drawing Figures

ACTUATING MEANS FOR FASTENER DRIVING TOOL

This invention relates to a portable fastener driving tool and, particularly, to a novel actuating means which prevents actuation of the tool under certain conditions.

Currently in wide usage in the construction industry are portable fastener driving tools that are used for driving nails and other types of fasteners. These tools are trigger-actuated, which trigger mechanisms are usually provided with devices to prevent firing of the tool under certain conditions. In a typical fastener driving tool of the pneumatic type, the pulling of the trigger operates a valve mechanism that in turn controls the flow of high-pressure air to a driving piston. The driving piston is slidably disposed in a cylinder and has connected thereto a driving member. When the piston is acted on by high-pressure air, the driving member engages a fastener and drives a fastener into a workpiece.

It has been common practice to employ mechanisms to insure that the trigger will not be actuated to drive a fastener until the tool is in engagement with a workpiece. This typically takes the form of what is known as a bottom trip mechanism, which is a mechanism that is disposed adjacent the nose piece of the tool where the fastener exits from the tool. The work contacting mechanism is resiliently biased to extend beyond the nose piece and must be depressed by engagement of the tool with the workpiece in order for the tool to be fired. The work contacting mechanism includes a portion disposed adjacent the trigger assembly, and the trigger assembly is designed so that movement of the trigger is either (1) totally prevented until the bottom trigger mechanism engages a workpiece, or (2) sufficient movement of the trigger to effectuate actuation of the tool will not take place to operate a valve mechanism controlling the operation of the tool until the bottom trip mechanism is in engagement with the workpiece. The usual bottom trip mechanism employed in a fastener driving tool, while working in conjunction with the trigger, does not normally require any particular sequence of operation between the trigger assembly and the bottom trip mechanism. It is usually necessary that both the bottom trip be engaged and the trigger pulled before the tool will be fired, but this can be done in any sequence.

Thus, with the use of a bottom trip mechanism, the tool cannot be fired until the bottom trip mechanism is engaged with a workpiece. This is the most widely used method in the industry. However, it has been recognized that it would be useful under certain circumstances to prevent firing of the tool by engagement of the bottom trip mechanism when the trigger is held in the pulled position. Thus, if an operator is carrying the tool around the work site with his hand on the trigger, the tool will not be fired if the bottom trip mechanism is contacted.

Various mechanisms have been employed to insure that the tool will not be fired unless the proper sequence is followed: (1) first engaging the bottom trip mechanism and then (2) pulling the trigger. One of these mechanisms is illustrated and described in Rogers U.S. Pat. No. 3,056,965. This is generally referred to as a trigger lockout type device, which means that the trigger cannot be operated until the bottom trip mechanism has been activated. This type of mechanism, however, is subject to the deficiency that even though the trigger cannot be activated until the bottom trip mechanism is engaged, the tool can be inadvertently fired if the operator maintains continuous pressure on the trigger while carrying the tool, and the bottom trip mechanism is inadvertently moved so the trigger assembly is free of the bottom trip mechanism.

It can be appreciated that under certain circumstances it would be advantageous that the actuating means for the tool be designed so that only a single fastener can be fired from the tool by following the prescribed sequence of first contacting the workpiece and then pulling the trigger, and that subsequent fasteners can only be singly fired if the operator were to release the trigger after each firing. This would prevent the inadvertent firing of a subsequent fastener unless and until the operator were to release the trigger, and the sequence again followed calling for the first step to be engagement of the tool with a workpiece.

However, while this mode of operation is highly desirable, it would also be very useful to the trade if the tool could be continuously fired by the bottom trip mechanism, if desired. This "bottom trip mode" of operation should be attainable while maintaining the desired features above referred to, and thus should be readily available to the operator and require a positive conscious act to make the operator aware of the change of the tool condition to avoid the inadvertent firing above referred to. This additional feature should be designed requiring the trigger to be held in the "pulled" condition, and if the trigger is released the tool will no longer be in the bottom trip mode and further firing of the tool will require the prescribed sequence to be followed of first engaging the workpiece and then pulling the trigger.

That is to say, it would be desirable to set the actuating mechanism so that the tool can be repeatedly fired by engagement of the bottom trip mechanism, but that once the trigger is subsequently released the actuating mechanism must be recycled with the bottom trip mechanism actuated before the trigger is operated to permit another fastener to be driven.

In accordance with the present invention, there is provided a novel actuating mechanism which insures that the prescribed sequential mode of firing takes place calling for first actuating the bottom trip mechanism and then pulling the trigger before a fastener is fired. If the trigger is initially pulled and then the bottom trip mechanism is actuated, the trigger mechanism will be effectively locked out of position, thus preventing the tool from being fired. However, further mechanisms are provided which enable the tool to be placed in a "bottom trip mode," where the tool will be fired by engagement of the tool with a workpiece, with the trigger maintained in a "pulled" position. This includes a push button arrangement provided as part of the trigger assembly whereby the trigger assembly when pulled into a position where additional movement caused by the bottom trip mechanism will act to fire the tool is retained in this position as long as the operator continues maintaining pressure on the trigger assembly. In this mode, the tool will be operated to fire a fastener each time the bottom trip mechanism engages with the workpiece. When the trigger is subsequently released, the actuating mechanism automatically goes back into its sequential mode, which means that for a subsequent fastener to be driven, the bottom trip mechanism will first have to be actuated and then the trigger pulled to activate the tool.

A structure by which the above and other advantages of the invention are attained will be described in the following specification, taken in conjunction with the accompanying drawings illustrating a preferred structural embodiment of the invention in which.

Figure 1:
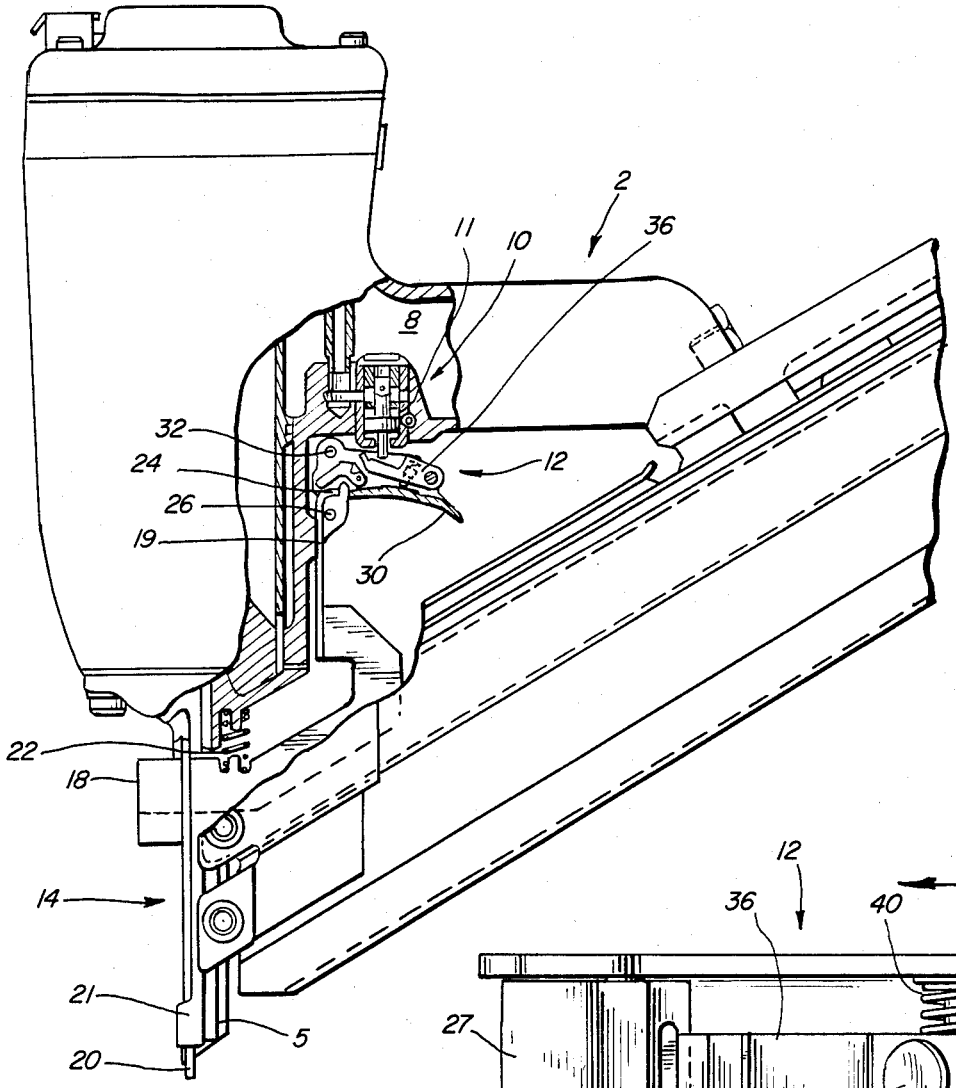
FIG. 1 is a side elevation of a pneumatic fastener driving tool, partially broken away to show details of the bottom trip mechanism and the trigger assembly which acts to operate the tool to drive a fastener.

Referring now more particularly to FIG. 1, there is shown a portable pneumatic fastener driving tool generally indicated at 2 embodying the novel actuating mechanism. The tool 2 shown is of a conventional, pneumatically operated fastener driving device which includes a housing 4 within which is located a driving piston slidable within a cylinder and having a driving member (not shown) secured thereto, which extends through the nose portion 5 of the housing 4 to engage and drive a fastener therethrough and into a workpiece. The flow of high-pressure air from the pressure chamber 8 to actuate the driving piston is regulated by a valve mechanism 10, which in turn is controlled by applicant's novel trigger assembly 12. As aforementioned, the pneumatic fastener driving tool shown is merely representative of one that can be employed, and details of the valve mechanism controlling the flow of air to the driving piston, the piston, etc., can be seen by referring to Howard et al. U.S. Pat. No. 3,815,475, which is assigned to the assignee of the present invention. The details of the fastener driving tool above referred to are not important to an understanding of the present invention, but such details as referred to above are hereby incorporated by reference from the aforementioned Howard et al. patent into the instant application.

To prevent actuation of the tool until it is engaged with a workpiece, there is provided a bottom trip mechanism 14 that is disposed alongside the nose portion 5 of the fastener driving tool though which the fastener is exited by operation of the driving piston and attached driving member. The fasteners (not shown) are directed into the nose portion 5 from a conventional magazine 6 secured to the housing 4.

The bottom trip mechanism 14 includes a bracket assembly 18 which includes an upper plate section 19 leading to the trigger assembly 12. Secured to the bracket 18 at its lower end is an actuator 20 which extends through a guide 21 disposed adjacent the nose portion 5. The bottom trip mechanism is maintained in the position shown in FIG. 1, where it extends outwardly beyond the nose portion 5 by compression spring 22 disposed between the upper portion of the bracket assembly 18 and housing 4. The upper plate section 19 of the bracket 18 includes an upper lip portion 24 which coacts with the novel trigger assembly which will be discussed hereinafter. Pin 26 secured to housing 4 limits the downward movement of bracket 18.

Figure 3:
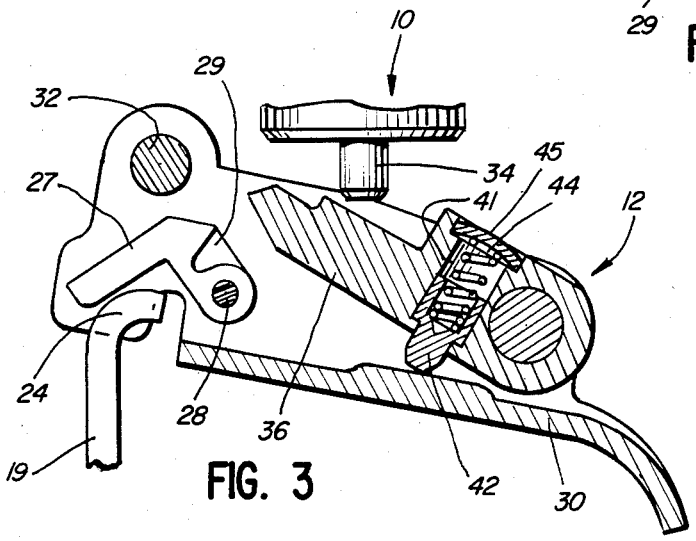
FIG. 3 is an enlarged cross-sectional view of the trigger mechanism prior to proper sequential actuation of the bottom trip mechanism and trigger.

Referring now to FIG. 3, there is shown the trigger assembly 12 in the relaxed position. That is to say, the U-shaped trigger 30, which is pivotally mounted about pin 32, is spaced from valve pin 34 which controls the movement of the valve 10 to effect firing of the tool by bringing about the introduction of high-pressure air to operate the driving piston in the driving stroke. Pin 34 is normally spring-biased outwardly to the position shown in FIG. 3 by spring 11 (see FIG. 1).

The trigger assembly includes a lever member 36 that is pivotally connected to the U-shaped trigger member 30 at one end thereof. It is this member 36 that functions to contact and move the valve pin 34 to control the firing of the tool. The lever is resiliently spaced from the base of the trigger member 30 into the position shown in FIG. 3 by the button 42 disposed in hole 41, which button 42 is spring-biased outwardly by the spring 44. Spring 44 is retained in place by cap 45. Thus, the position of the lever 36 and the movement of the trigger assembly 12 will determine the firing mode of the tool. Accordingly, if firing of the tool requires a predetermined movement of the lever 36 when in engagement with the valve pin 34, this travel is occasioned by pivoting of the trigger 30 and operation of the bottom trip mechanism now to be described.

The interaction between the bottom trip mechanism 14 and the trigger assembly takes place through an L-shaped activator member 27 that is pivotally mounted to the trigger 30 by pin 28, which is located adjacent pivot pin 32 (see FIG. 3). With the tool spaced from the workpiece, the bottom trip mechanism 14 is in the position shown in FIGS. 1 and 3, with the lip 24 of the upper plate section 19 being out of engagement with the activator 27.

Figure 5:
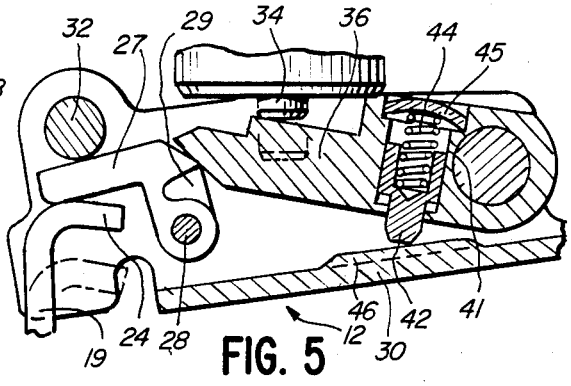
FIG. 5 is a view similar to FIG. 3 showing the trigger assembly, when positioned in the sequential mode to fire the tool.

When the tool is fired in the prescribed sequential mode, the valve pin 34 is engaged by the lever 36 to move it a prescribed amount to effect movement of the valve 10 to fire the tool. This is accomplished by initial movement of the bottom trip mechanism 14 which moves the lip 24 upwardly into engagement with the activator 27 to rotate it in a clockwise position to place it in the general position shown in FIG. 5. Essentially, movement of the lip 24 moves the activator 27 against the underside of lever 36 to move lever 36 against valve pin 34. Then pivoting of the trigger 30 about pin 32 moves lever 36 about activator 27 to depress valve pin 34 to fire the tool (FIG. 5).

Figure 6:
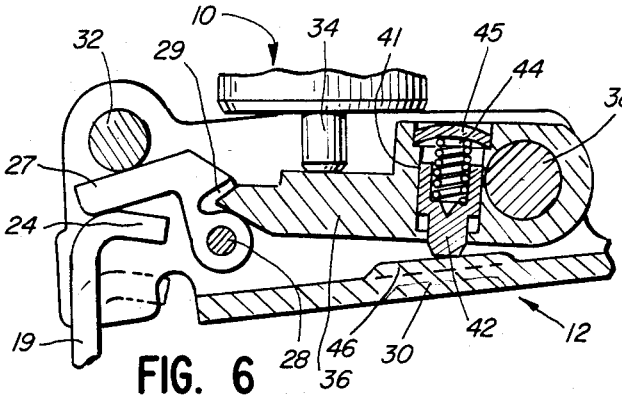
FIG. 6 is a view similar to FIG. 3 with the trigger assembly in the inoperative position due to pulling of the trigger before the bottom trip mechanism is engaged with a workpiece.

If the proper sequence of firing the tool is not followed and the trigger assembly is moved in a counterclockwise direction before actuation of the bottom trip mechanism, the actuating means will find itself in the position shown in FIG. 6. That is to say, lever member 36 will have been moved into the position shown in FIG. 5 by counterclockwise movement of the trigger member 30 about the pivot pin 32, which movement will place the lever member adjacent the valve pin 34, but will not activate the valve mechanism 10. Subsequent movement of the bottom trip mechanism will move the lip 24 against the activator 27 to move the activator in a clockwise position to that shown in FIG. 5, wherein the lever 36 will be located in the slot 29 of the activator 27. It is important to note that the slot 29 has a width substantially equal to that of lever 36, but is less than that of the width of activator 27 for reasons to be described hereinafter. Thus, the activator 27 will not act to move the lever 36 to move the valve pin 34 to fire the tool as previously discussed when the proper firing mode is followed.

As previously mentioned, it is a feature of this invention that the tool cannot be fired unless the prescribed sequence is followed. That is, initially the bottom trip must be actuated before the trigger is pulled. In this way, if the operator were to carry the tool with the trigger depressed the tool will not fire, regardless of what happens to the bottom trip mechanism.

However, it would be desirable that the tool be capable of being fired by mere actuation of the bottom trip mechanism when the trigger is held in the depressed condition. In the instant invention, this is accomplished by a novel arrangement which must be manually activated by the operator, and which will only be effective when the trigger is continuously retained in its actuating condition. That is to say that the operator must manually and continuously activate a mechanism that will enable the tool to be continuously fired by engagement of the bottom trip mechanism as long as the trigger is being retained in the pulled condition. Once the trigger is released, the sequential mode must again be followed before a fastener will be fired. That is to say, the bottom trip mechanism must be first activated, after which the trigger can be pulled to drive a fastener.

Figure 10:
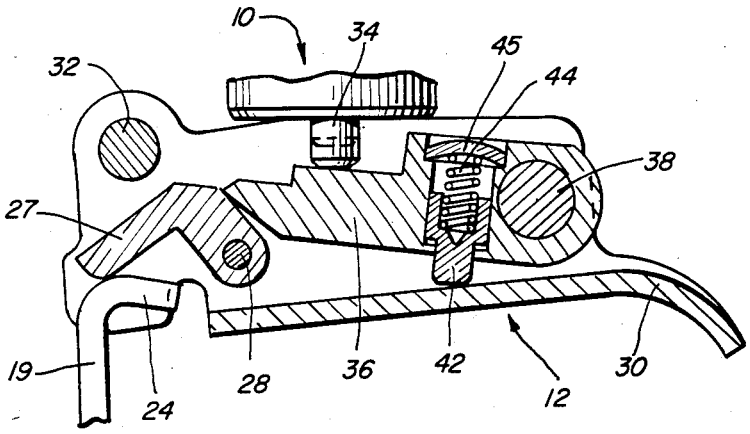
FIG. 10 is a view similar to FIG. 8 taken along line 10—10 of FIG. 8, with the trigger assembly in position to be repeatedly operated to fire the tool by the bottom trip mechanism.

To accomplish this "bottom trip mode" of operation, the trigger assembly 12 is provided to retain the lever 36 in the position shown in FIG. 10 when the trigger 30 is pulled and held. That is, the lever must be so positioned that after the trigger is pulled and held, movement of the activator 27 by the bottom trip mechanism 14 will move lever 36 in engagement with valve pin 34 the prescribed distance to fire the tool.

Figure 4:
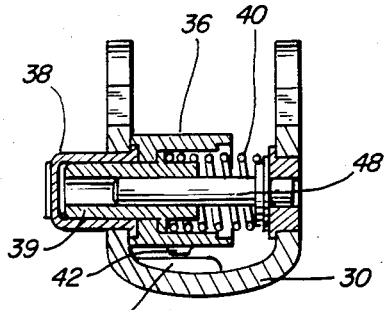
FIG. 4 is a cross-section view taken along lines 4—4 of FIG. 2.

To place the tool in the "bottom trip mode," reference is first made to FIG. 4, which illustrates a cross-sectional view of a reset button arrangement forming part of the trigger assembly provided for this purpose. It consists of a button 38 which is located in an opening in a sidewall of the U-shaped trigger member 30, which button 38 includes a sleeve portion 39 that is slidably disposed on a guide rod 48 (which rod also serves as the pivot pin for the lever 36) located in an opposite sidewall. The button is biased outwardly by spring 40. As shown in FIG. 3, the lever 36 is also provided with the spring-biased push button 42, as described hereinbefore. When the trigger assembly is in the sequential mode, the push button 38 extends outwardly and the button 42 is in the position shown in FIG. 3. It is to be noted that in the sequential mode operation the spring-loaded button 42 rests on a raised surface 46 of the trigger member 30. The spring forces exerted by the springs 11, 40 and 44 are designed to maintain the valve pin 34, button 42, and button 38, respectively, in the positions shown in FIGS. 1–4. When the trigger assembly is in this position, the spring force exerted by the spring 11 of the valve 10 is sufficiently large that after the bottom trip is released the pin 34 will force the lever 34 downwardly against the action of the spring 44. If the bottom trip is reactuated, with the trigger held, the activator is moved to the position shown in FIG. 6, where it rides over the lever 36, which falls into slot 29, thus preventing firing of the tool.

Figure 2:
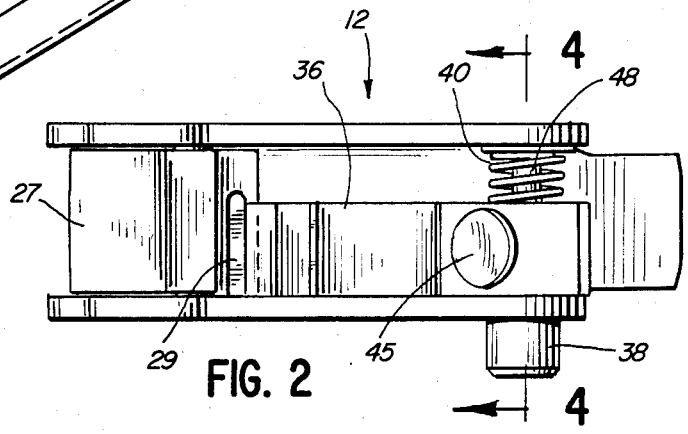
FIG. 2 is a top view of the trigger assembly shown in the sequential mode.
Figure 7:
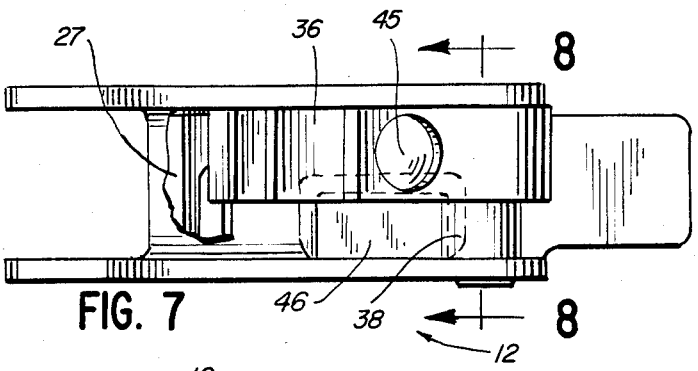
FIG. 7 is a view similar to FIG. 2, but showing the trigger assembly in position to be operated by the bottom trip mechanism.
Figure 8:
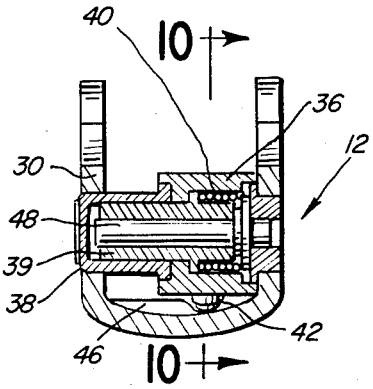
FIG. 8 is a cross-sectional view taken along line 8—8 of FIG. 7.

When the bottom trip mode is required, the button 38 is pushed inwardly to move lever 36 to the position shown in FIGS. 7 and 8. This can be done before or after the trigger has been pulled. When this occurs, the lever 36 is moved to the position shown in FIG. 8, with the button 42 riding off of the surface 46. As particularly shown in FIG. 7, the lever 36 is now not disposed immediately above the slot 29 formed in activator 27, as shown in FIG. 2.

Figure 9:
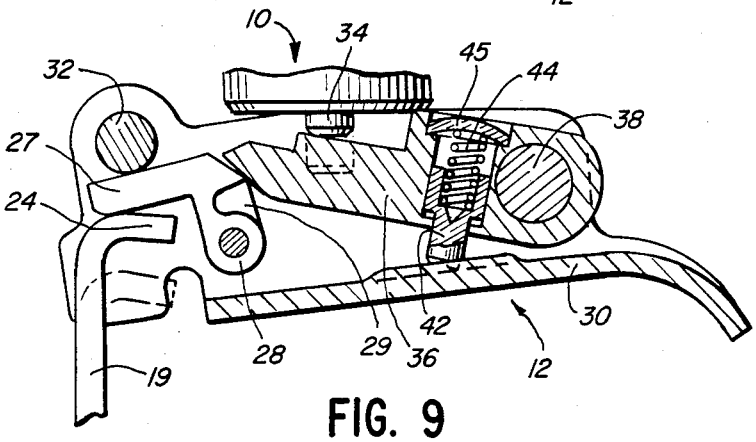
FIG. 9 is a view similar to FIG. 3 showing the trigger assembly, when positioned in the bottom trip mode to fire the tool.

With the trigger pulled and the push button 38 moved inwardly, the actuating mechanism finds itself in the position shown in FIG. 10, wherein the bottom trip mechanism has not been activated. When the bottom trip mechanism now moves, the activator 27 will force the lever 36 upwardly against the valve pin 34 to fire the tool. The firing mode is seen in FIG. 9. However, since, as aforementioned, the lever 36 is now not directly above the slot 29, if the trigger remains in the pulled position, which is that shown in FIG. 10, release of the bottom trip mechanism would not result in the lever moving into the slot 29, as shown in FIG. 6. Thus, as long as the trigger is held, the tool will be fired each time the bottom trip mechanism is activated.

When the trigger is released, it will return to the position shown in FIG. 3. When the trigger is released, the effective force of the spring 44 is reduced, with the result that the spring 40 is now effective to move the button 38 to the left, as shown in FIG. 7. The spring force 40 is sufficiently large with respect to the reduced force of spring 44 so that the lever 36 is moved to the left, as shown in FIG. 8, with the button 42 riding on to the surface 46 to the position shown in FIG. 4. With the mechanism now in the position shown in FIG. 3, the tool is set to be fired in the sequential mode.

It is to be noted that while a pneumatic fastener driving tool has been shown, the novel trigger actuating means disclosed herein could be used for other types of portable tools including, but not limited to electric tools, gas driven tools, and tools other than fastener driving tools which require the actuation of a control mechanism and where the desirable features inherent in applicants' invention are desired.

What is claimed is:

1. A fastener driving tool including a portable housing, fluid pressure operated fastener driving means in said housing, a magazine secured to said housing and adapted to provide fasteners to be driven by said fastener driving means, means for controlling the operation of said fastener driving means, and a bottom trip assembly having a workpiece contacting member and activator contacting portion carried by said housing and movable between an operative position in engagement with the workpiece and an inoperative position when it is out of engagement with a workpiece; the improvement comprising an actuating means connected to said housing for regulating the operation of said control means, said actuating means including a trigger pivotally connected to said housing including an activator connected to said trigger and positioned to be engaged by said activator contacting portion when the bottom trip assembly is moved to its operative position and a lever pivotally connected to said trigger and positioned to be engaged by said activator and to operatively engage said control means; said lever, activator, and activator contacting portion being constructed and arranged, whereby sequential movement of said activator contacting portion by a workpiece contacting member, activator, lever and trigger will engage said control means to fire said tool and operation of said trigger prior to engagement of said workpiece contacting member will be ineffective to fire said tool.

2. A fastener driving tool as set forth in claim 1 in which the activator is pivotally connected to said trigger and has a first portion positioned to be contacted by said activator contacting portion and defines a surface that engages an end of said lever opposite to its pivotal connection with said trigger.

3. A fastener driving tool as set forth in claims 1 or 2 in which said trigger is U-shaped and the lever includes a first spring-biased button assembly acting to bias the lever away from the bottom wall of said trigger and toward engagement with said control means.

4. A fastener driving tool as set forth in claim 3 in which said activator defines a groove formed in said surface, which groove will receive said end of said lever to prevent operation of said control means in the event the trigger is pulled prior to operation of said bottom trip mechanism.

5. A fastener driving tool as set forth in claim 4 in which said trigger defines a bottom raised surface on its bottom wall and includes a second spring-biased push button assembly disposed between the sidewalls of said trigger, which assembly normally biases said push button to maintain said first button assembly on said raised surface.

6. A fastener driving tool as set forth in claim 5 in which said groove is coextensive with said lever and actuation of said second button assembly moves the first button assembly off of said raised surface to move said lever out of alignment with said groove, whereby when the trigger is pulled, the lever will be maintained in position to be repeatedly moved to continuously fire said tool in response to movement of the bottom trip mechanism.

7. A fastener driving tool as set forth in claim 6 in which as long as the trigger is pulled the spring forces acting on said second push button will be insufficient to move the lever to move the first button onto said raised surface but when the trigger is released the forces acting on said first button are reduced to permit the lever to be moved to move the first button onto said raised surface.

8. An actuating means for a fastener driving tool having a bottom trip mechanism comprising a trigger pivotally connected to said tool and positioned to actuate a control mechanism for firing said tool including an activator connected to said trigger and positioned to be actuated by said bottom trip mechanism, a lever pivotally connected to said trigger and positioned to be engaged by said activator to operatively engage said control mechanism; said trigger, lever, and activator being constructed and arranged whereby sequential movement of said activator, lever and trigger will result in the firing of said tool and movement of said trigger prior to movement of said activator will render said lever inoperative to fire said tool.

9. An actuating means as set forth in claim 8 in which said trigger is U-shaped and the lever includes a first spring-biased button assembly acting to bias the lever away from the bottom wall of said trigger and toward engagement with said control means.

10. An actuating means as set forth in claim 9 in which said trigger defines a bottom raised surface on its bottom wall and includes a second spring-biased push button assembly disposed between the sidewalls of said trigger, which assembly normally biases said push button to maintain said first button assembly on said raised surface.

11. An actuating means as set forth in claim 10 in which said activator defines a groove formed in said surface, which groove will receive said end of said lever to prevent operation of said control means in the event the trigger is pulled prior to operation of said bottom trip mechanism.

12. An actuating means as set forth in claim 11 in which said groove is coextensive with said lever and actuation of said second button moves the lever to move the first button off of said raised surface which moves said lever out of contact with said groove, whereby when the trigger is pulled, the lever will be maintained in position to be repeatedly moved to continuously fire said tool in response to movement of the bottom trip mechanism.

13. An actuator means as set forth in claim 12 in which as long as the trigger is pulled the spring forces acting on said second push button will be insufficient to move the lever to move the first button onto said raised surface but when the trigger is released the forces acting on said first button are reduced to permit the lever to be moved to move the first button onto said raised surface.

* * * * *